US007649502B2

(12) United States Patent
Hung et al.

(10) Patent No.: US 7,649,502 B2
(45) Date of Patent: Jan. 19, 2010

(54) MULTI-BAND ANTENNA

(75) Inventors: Chen-Ta Hung, Tu-Cheng (TW); Yun-Long Ke, Tu-Cheng (TW); Po-Kang Ku, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 173 days.

(21) Appl. No.: 11/799,764

(22) Filed: May 1, 2007

(65) Prior Publication Data

US 2007/0257848 A1 Nov. 8, 2007

(30) Foreign Application Priority Data

May 2, 2006 (TW) ..... 95115547 A

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS 5,448,253 A * 9/1995 Ponce de Leon et al. .... 343/702
5,495,260 A * 2/1996 Couture ..... 343/795
6,985,108 B2 * 1/2006 Mikkola et al. ..... 343/700 MS
7,352,326 B2 * 4/2008 Korva et al. ..... 343/700 MS

* cited by examiner

*Primary Examiner*—Tho G Phan
(74) *Attorney, Agent, or Firm*—Wei Te Chung; Andrew C. Cheng; Ming Chieh Chang

(57) ABSTRACT

A multi-band antenna used in a portable electrical device can work in WWAN and GPS at the same time. The multi-band antenna includes a PCB having a through hole, a first antenna body comprising a first radiating element and a first grounding element formed on a first surface of the PCB, a second antenna body formed on a second surface of the PCB, and a feeding line having an inner conductor electrically connecting to the first radiating element and an outer conductor electrically connecting to the first grounding element. The second antenna body comprises a second radiating element, a second grounding element, and a connecting element connecting the second radiating element and the second grounding element. The first radiating element and the second radiating element electrically connect with each other via the through hole of the PCB.

18 Claims, 3 Drawing Sheets

MULTI-BAND ANTENNA

BACKGROUND OF THE INVENTION

1. Field of the Invention

The present invention relates generally to an antenna, and more particularly to a multi-band antenna used in a portable electronic device.

2. Description of the Prior Art

With the development of wireless communication, more and more portable electronic devices, such as a notebook, install an antenna system for working in a Wireless Local-area Network (WLAN). Transmitting and receiving signals plays an important role in wireless communication process. In recent years, a majority of WLAN bases on Bluetooth technical standard or 802.11 technical standard. Antenna in Bluetooth technical standard is based on 2.4 GHz frequency band, and in 802.11 technical standard is based on 2.4 GHz and 5 GHz. So, antenna in notebook mostly works at the above frequency bands at the present time.

However, more and more people dissatisfy their electronic devices only working in an immovable network (signal transmission distance is 10 meters in Bluetooth which almost doesn't permit the electronic devices to move.) or a only short-haul movable network (signal transmission distance is 150 meters of 802.11 technical standard which limits the move of the electronic device except between work rooms.) of the WLAN. Making the portable electronic devices working in WWAN (Wireless Wide Area) or GPS (Global Positioning System) is a purpose of the many people. Because the portable electronic devices can work or amuse in broaden range in WWAN or GPS. In recent years, WWAN adopts two technical standards of GSM and CDMA. Operating frequency bands of the GSM and CDMA are 900/1800 MHz, and operating frequency band of the GPS is 1.575 GHz. So, an antenna of a notebook must operate in above frequency bands, the portable electronic device is capable of working in WWAN and GPS. At present, the antenna used in the notebook only can work in one of technology standards of the WLAN, WWAN, and GPS. The antenna can't work in above three technology standards at the same time unless install three sets of antennas respectively work in above technology standards in the notebook. However, this is difficult to install three sets antennas in the limited inner space of the notebook and the antennas may influence one another when working. In addition, installing three sets of antennas also increase the cost of the notebook compared with installing one set antenna.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna with wide frequency bandwidth and fitting to be installed in a notebook or other portable electrical devices.

In order to implement the above object and overcome the above-identified deficiencies in the prior art, a multi-band antenna comprises a PCB having a through hole, a first antenna body comprising a first radiating element and a first grounding element formed on a first surface of the PCB, a second antenna body formed on a second surface of the PCB, and a feeding line having an inner conductor electrically connecting to the first radiating element and an outer conductor electrically connecting to the first grounding element. The second antenna body comprises a second radiating element, a second grounding element, and a connecting element connecting the second radiating element and the second grounding element. The first radiating element and the second radiating element electrically connect with each other via the through hole of the PCB.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
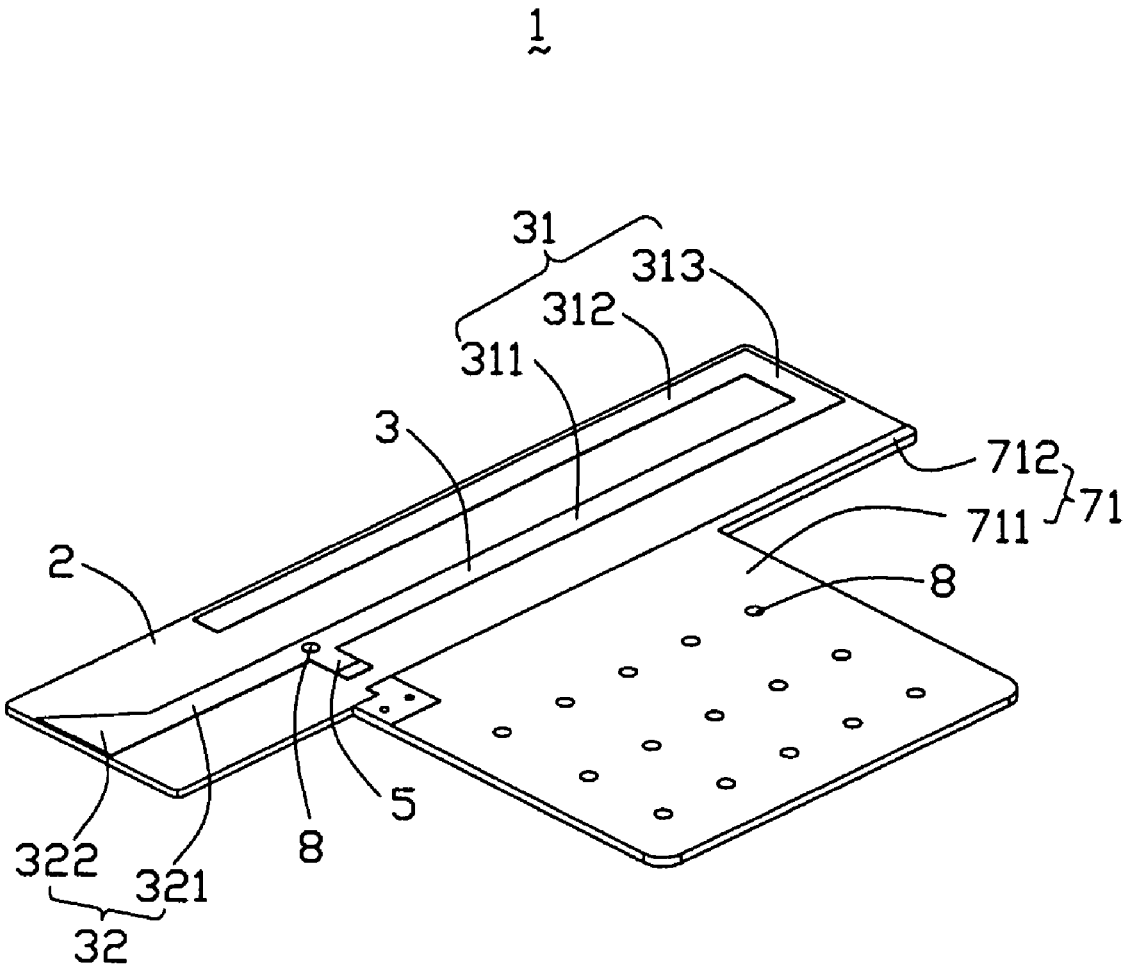
FIG. 1 is a perspective view of a multi-band antenna in accordance with the present invention.
Figure 2:
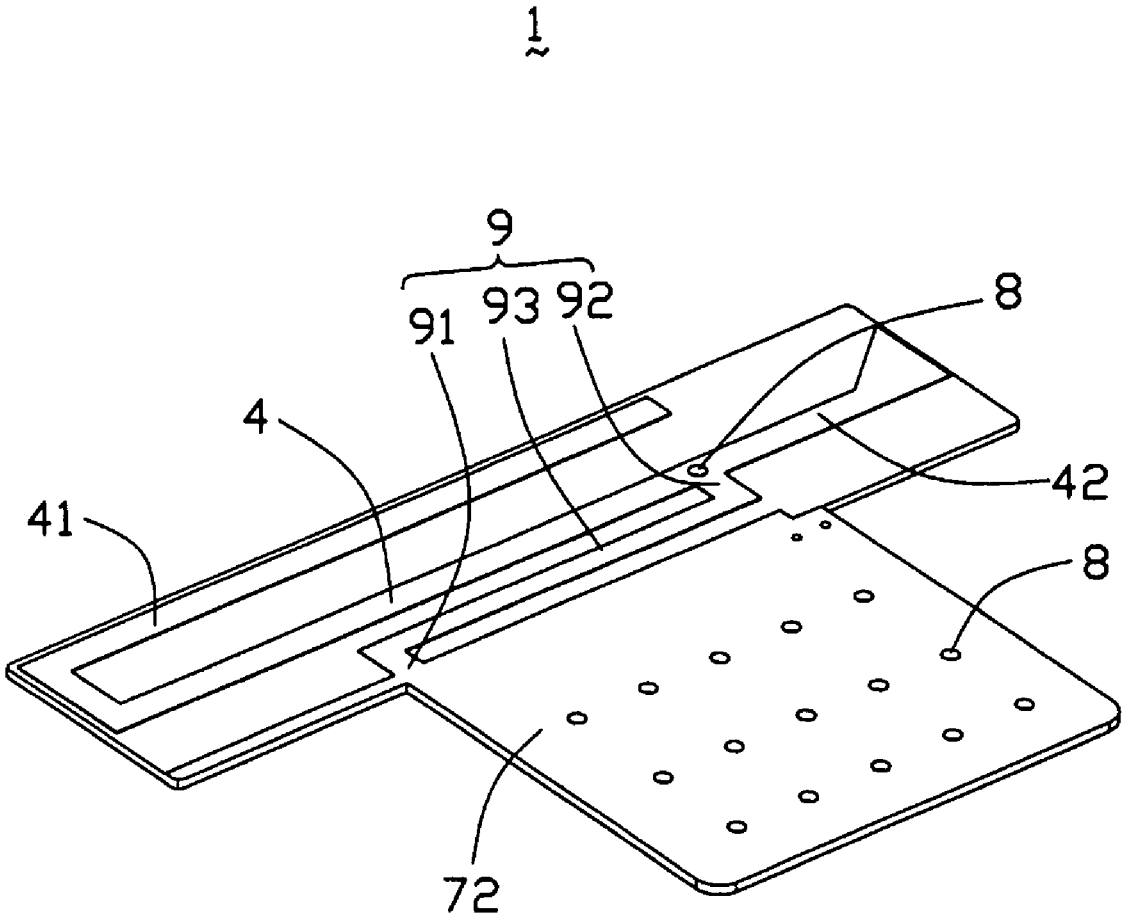
FIG. 2 is a perspective view similar to FIG. 1, but take from a different aspect view.

Referring to FIG. 1 to FIG. 2, a multi-band antenna 1 according to the present invention operates at WWAN (824-960 MHz and 1710-2170 MHz) and GPS (1575 MHz) at the same time. The multi-band antenna 1 comprises a T-shape PCB (Printed Circuit Board, PCB) 2, a first antenna body (not labeled) formed on a first surface of the PCB 2, and a second antenna body (not labeled) formed on a second surface of the PCB 2.

The first antenna body comprises a first radiating element 3 formed on the upper side of the first surface of PCB 2 and a first grounding element 71 formed on the lower side of the first surface of the PCB 2 and independent from the first radiating element 3. Of course, for perfect impedance match, the first radiating element 3 and the first grounding element 71 in the present invention are arranged to be independent from each other, it does not influence the operating performance of the multi-band antenna 1 to connect the first radiating element 3 with the first grounding element 71. The first radiating element 3 comprises an inverted U-shape first radiating arm 31 operating at lower frequency (824-960 MHz) and a second radiating arm 32 operating at higher frequency (1710-2170 MHz) with shorter length than that of first radiating arm 31. A feeding cap 5 extends from the joint of the first radiating arm 31 and the second radiating arm 32 toward the first grounding element 71. A through hole 8 is defined in the joint of the first radiating arm 31, the second radiating arm 32, and the feeding cap 5 and extends through the PCB 2. The through hole 8 is plated with conductive material and thus, perpendicularly impenetrates the first antenna body, the PCB 2, and the second antenna body from up-to-down direction.

The first radiating arm 31 comprises a first radiating portion 311 connecting to the second radiating arm 32, a second radiating portion 312 parallel to the first radiating portion 311, and a third radiating portion 313 connecting the first radiating portion 311 and the second radiating portion 312 and perpendicular to the first radiating portion 311 and the second radiating portion 312. The second arm 32 comprises a main body 321 located on common beeline with the first portion 311 of the first radiating arm 31 and an enlarged end portion 322 extending from the main body 321. The enlarged portion 322 shows a right-angled triangle shape and has a wide terminal for achieving more wide frequency band.

The first grounding element 71 comprises a rectangle patch 711 and a narrowband 712 extending from a side of the rectangle patch 711 and parallel to the first radiating portion 311 of the first radiating arm 31. A corner of the rectangle patch 711 near the feeding cap 5 is cut for multi-band antenna 1 achieving good frequency performance in the preferred embodiment.

A feeding line (not shown) has an inner conductor electrically connecting to the feeding cap 5 and an outer conductor electrically connecting to the first grounding element 71.

The second antenna body comprises a second radiating element 4 formed on an upper side of the second surface of the PCB 2, a second grounding element 72 formed on a lower side of the second of the PCB 2 and independent from the second radiating element 4, and a connecting element 9 connecting the second radiating element 4 and the second grounding element 72. A lot of through holes 8 are formed in the rectangle patch 711. The through holes 8 perpendicularly impenetrate the first grounding element 71, PCB 2, and the second grounding element 72 from up-to-down. The second radiating element 4 comprises a third radiating arm 41 operating at lower frequency same as the first radiating arm 31 and a fourth radiating arm 42 operating at higher frequency same as the second radiating arm 32. The structure of the second radiating element 4 and the second grounding element 72 respectively are same as the first radiating element 3 and the first grounding element 71 and are arranged symmetrically relative to the PCB 2. So, detailed structures of the second radiating element 4 and the second grounding element 72 are omitted hereinafter.

The connecting element 9 comprises a first branch 91 perpendicular to the second grounding element 72, a second branch 92 extending from a joint of the third radiating arm 41 and the fourth radiating arm 42 and parallel to the first branch 91, and a third branch 93 connecting the first branch 91 and the second branch 92 and perpendicular to the first branch 91 and the second branch 92. The through hole 8 is thus formed in the joint of the connecting element 9, the third radiating arm 41, and the fourth radiating arm 42.

Of course, the feeding line can selectively locate on the first or the second surfaces of the PCB 2. When the feeding line is located on the second surface, the inner conductor of the feeding line electrically connects to the joint of the second branch 92 and the third branch 93 and the outer conductor electrically connects to the second grounding element 72.

The first and the second grounding elements 71, 72 of the multi-band antenna 1 achieve good grounding performance in operation. However, only one grounding element also satisfies the need of the multi-band of 1 and does not influence the performance of the multi-band antenna 1.

There are a lot of through holes 8 on the PCB 2 for better performance of electrically connecting of the first grounding element 71 and the second grounding element 72.

Figure 3:
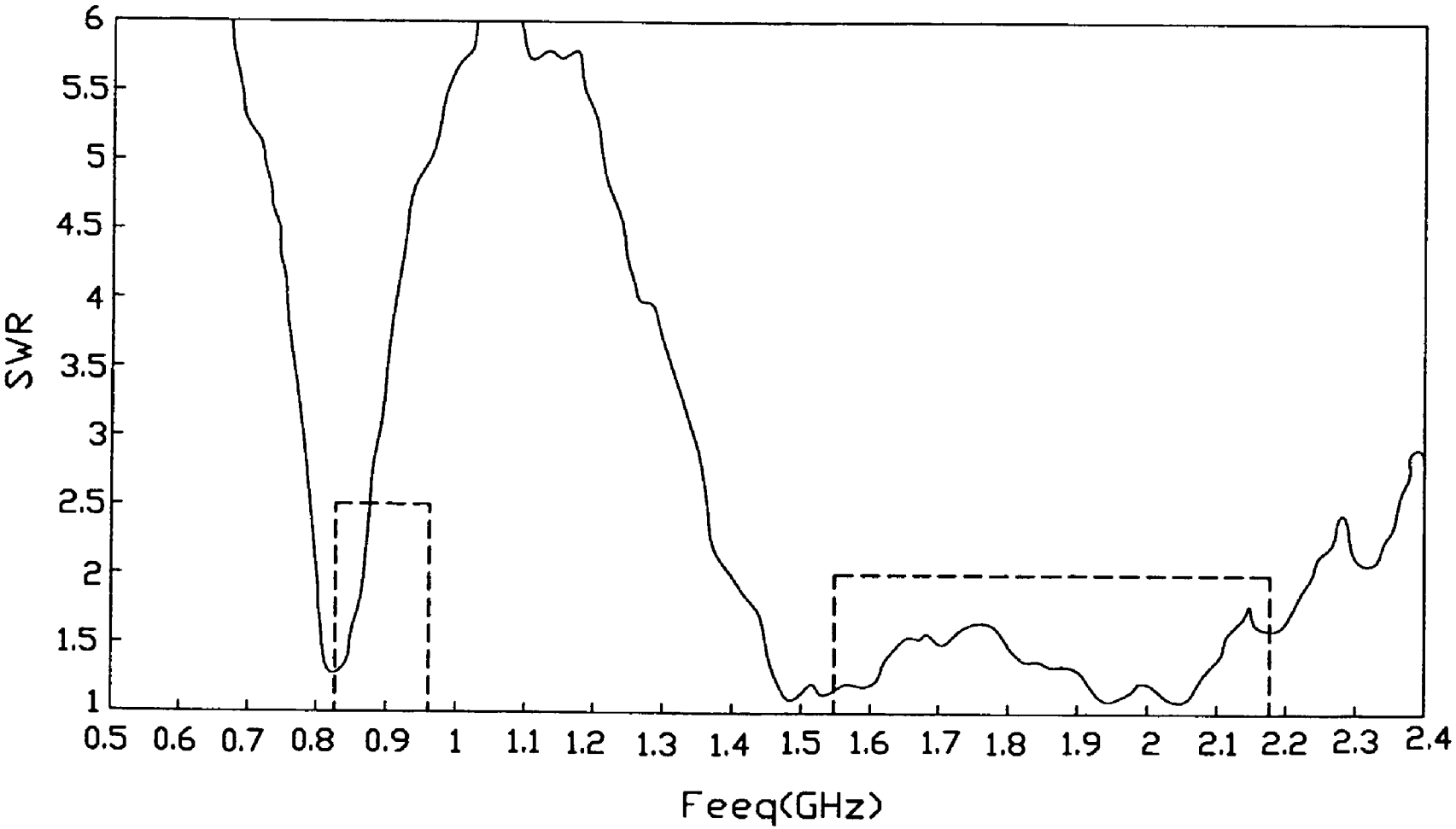
FIG. 3 is a test chart recording of Voltage Standing Wave Ratio (VSWR) of the multi-band antenna as a function of frequency.

Referring to FIG. 3, sets forth a test chart recording of Voltage Standing Wave Radio (VSWR) of the multi-band antenna 1 as a function of frequency. Note that VSWR drops below the desirable maximum value "2" in the 824-960 MHz frequency band and 1400-2200 MHz frequency band, which cover more than the total bandwidth of GPS (1575 MHz) and cover a majority of bandwidth of WWAN (low frequency band includes 824-960 MHz, high frequency band includes 1710-2170 MHz) and be provided with more wider frequency band of the operating at high frequency.

The multi-band antenna 1 with two antenna bodies of the present invention has better radiating intension compared with the single antenna body formed on the PCB 2. As well-known, the bigger the air dielectric area of an antenna (the area of an antenna contacting air) is, the bigger the radiation intensity of the antenna is. The multi-band antenna 1 of the present invention has better radiation intensity because it increases total area of the radiating element contacts air dielectric.

In the preferred embodiment, the first radiating element 3 is in mirror with the second radiating element 4. In fact, the first radiating element 3 being not in mirror with the second radiating element 4 does not influence normal working and radiating intensity of the multi-band antenna 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna adapted for used in a portable electronic device, comprising:

a PCB having a through hole;

a first antenna body formed on a first surface of the PCB, the first antenna body comprising a first radiating element with a first radiating arm operating at a lower frequency band and a second radiating arm operating at a higher frequency band, and a first grounding element; and a second antenna body formed on a second surface of the PCB, the second antenna body comprising a second radiating element having a third radiating arm operating at said lower frequency band and a fourth radiating arm operating at said higher frequency band; wherein the first radiating element and the second radiating element electrically connect with each other via the through hole of the PCB.

2. The multi-band antenna as claimed in claim 1, wherein the second antenna body also comprises a second grounding element and a connecting element connecting the second radiating element and the second grounding element.

3. The multi-band antenna as claimed in claim 2, wherein the PCB has a lot of through holes for electrically connecting the first grounding element and the second grounding element.

4. The multi-band antenna as claimed in claim 1, wherein a feeding cap extends from a joint of the first radiating arm and the second radiating arm, the inner conductor of the feeding line electrically connects to the feeding cap.

5. The multi-band antenna as claimed in claim 4, wherein a through hole forms at the joint of the first radiating arm and the second radiating arm for electrically connecting the first radiating element and the second radiating element.

6. A multi-band antenna adapted for used in a portable electronic device, comprising:

a PCB having a through hole;

a first antenna body formed on a first surface of the PCB, the first antenna body comprising a first radiating element; and a second antenna body formed on a second surface of the PCB, the second antenna body comprising a second radiating element, a second grounding element, and a connecting element connecting the second radiating element and the second grounding element; wherein the first radiating element and the second radiating element electrically connect with each other via the through hole of the PCB; wherein the first radiating element has a first radiating arm operating at a lower frequency band and a second radiating arm operating at a higher frequency band; and the second radiating element has a third radiating arm operating at said lower frequency band and a fourth radiating arm operating at said higher frequency band.

7. The multi-band antenna as claimed in claim 6, wherein the multi-band antenna comprises a feeding line having an inner conductor electrically connecting to the second radiating element and an outer conductor electrically connecting to the second grounding element.

8. The multi-band antenna as claimed in claim 7, wherein the PCB has a lot of through holes to electrically connect the first grounding element and the second grounding element, the through hole in plated with conductive material.

9. The multi-band antenna as claimed in claim 6, wherein the first radiating arm forms an inverted U-shape, the second radiating arm has an enlarged end.

10. The multi-band antenna as claimed in claim 6, wherein the through hole forms at the joint of the third radiating arm and the fourth radiating arm to electrically connect the first radiating element and the second radiating element.

11. A multi-band antenna comprising:

a printed circuit board defining opposite first and second surfaces thereon;

a first antenna body including a first radiating element on the first surface to work on at least two different frequency bands;

a second antenna body including a second radiating element on the second surface;

at least one grounding element formed on one of said first and second surfaces; wherein the first radiating element and said second element are electrically connected to each other via a conductive trace extending through said printed circuit board and reaching both said first surface and said second surface; wherein said trace is essentially located on one side of the first radiating element with respect to a whole extending length of said first radiating element while being spaced from either end of said first radiating element so as to result in said two different frequency bands.

12. The multi-band antenna as claimed in claim 11, wherein said conductive trace is formed in a corresponding through hole in the printed circuit board.

13. The multi-band antenna as claimed in claim 11, wherein said first radiating element defines a straight configuration between said trace and one end while a deflected section with at least one bend thereof between said trace and the other end so as to result in said two different frequency bands.

14. The multi-band antenna as claimed in claim 11, said printed circuit board defines a T-shaped configuration with a horizontal segment and a vertical segment linked to each other in a top view, wherein said first radiating element and said second radiating element are located on the horizontal segment while a first grounding element is located on the vertical segment.

15. The multi-band antenna as claimed in claim 14, further including a second grounding element cooperating with the first grounding element to be located on said second surface and said first surface, respectively, wherein a plurality of traces extend through the first and second surfaces to electrically connecting said first grounding element and said second element.

16. The multi-band antenna as claimed in claim 15, wherein the first radiating element and the first grounding element are directly connected with each other is a connecting element on the first surface, while the second radiating element and the second grounding element lacks said connecting element for direct connection on said second surface.

17. The multi-band antenna as claimed in claim 11, further including a first grounding element and a second grounding element respectively located on said first surface and said second surface thereon with a plurality of traces extending through the first and second surfaces to electrically connecting said first grounding element and said second element.

18. The multi-band antenna as claimed in claim 17, wherein the first radiating element and the first grounding element are directly connected with each other is a connecting element on the first surface, while the second radiating element and the second grounding element lacks said connecting element for direct connection on said second surface.

* * * * *